US005819766A

United States Patent [19]

Craigen

[11] Patent Number: 5,819,766

[45] Date of Patent: Oct. 13, 1998

[54] BEAUTICIAN'S HELPER

[76] Inventor: Dorothy L. Craigen, 2335 Honore Ave., N. Chicago, Ill. 60064

[21] Appl. No.: 621,222

[22] Filed: Mar. 25, 1996

[51] Int. Cl.[6] ..... A45D 40/24

[52] U.S. Cl. ..... 132/314; 132/212; 132/286; 206/388

[58] Field of Search ..... 132/314, 212, 132/286; 206/581, 388; 211/131, 129, 144; 248/159; 434/407

[56] References Cited

U.S. PATENT DOCUMENTS

| | | | |
|---|---|---|---|
| D. 160,688 | 10/1950 | Brock | 211/129 |
| 982,216 | 1/1911 | Madden et al. | 211/131 |
| 2,507,951 | 5/1950 | Barnes | 211/129 |
| 4,725,027 | 2/1988 | Bekanich | 248/129 |
| 4,865,283 | 9/1989 | Parker | 248/159 |
| 5,487,600 | 1/1996 | Griffin | 211/129 |
| 5,524,775 | 6/1996 | Kaine | 211/131 |

*Primary Examiner*—Gene Mancene
*Assistant Examiner*—Pedro Philogene
*Attorney, Agent, or Firm*—Paul H. Gallagher

[57] ABSTRACT

A main stand having a base, a main post having lower and upper sections on the base, the upper section being releasably held in a socket on the lower section. A cross bar is mounted on the upper end of the post. Clips are mounted on the cross bar for releasably holding hair pieces. A larger basket is mounted on the lower section of the post and a smaller cup on the upper section. An auxiliary stand includes a post in which the upper part of the main stand is temporarily held.

8 Claims, 2 Drawing Sheets

Fig. 5
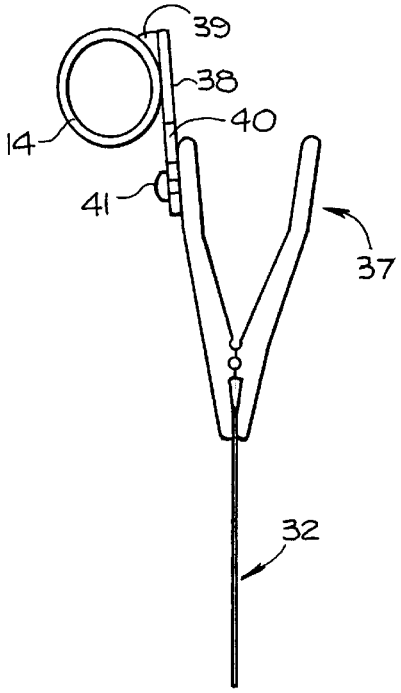
Fig. 6
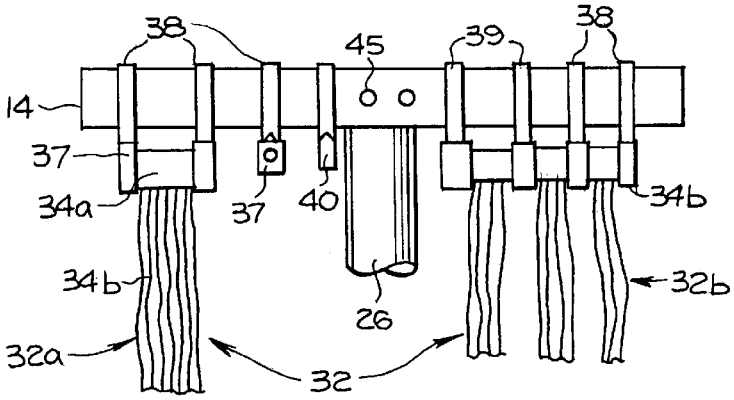
Fig. 7
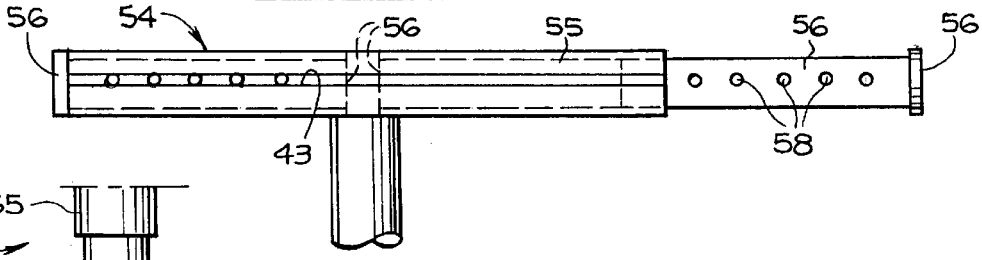
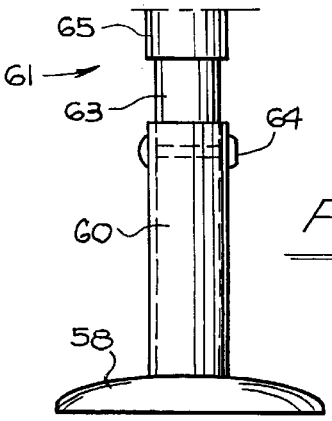
Fig. 8

BEAUTICIAN'S HELPER

SUMMARY OF THE INVENTION

The invention resides in the field of hair treatment and particularly holding hair pieces to apply to the head to cover sparse areas, or to add to quantities of natural hair already in place.

Such a hair piece typically includes a relatively long backing strip with filaments or hairs secured at one end to the strip, and extending perpendicularly thereto. These are a large number of the hairs, fitted close together in a mass or continuation extending the length of the backing strip.

In treatment of the hair piece, to apply it to the head, the hairs are curled or otherwise shaped, and to do that effectively it is necessary to hold the backing strip itself in a particular position to enable the operator to properly manipulate the hairs. Heretofore, this has not been a satisfactory means for so holding the strip.

A broad object of the invention is to provide a holder for backing strips and hair pieces as referred to above.

Another object is to provide a holder of the foregoing character having the following features and advantages:

1. The strip and/or hair piece is easily mounted on and detached from the device.
2. The strip is mounted in position greatly facilitating working with it.
3. The device includes a convenient arrangement for holding appropriate items used in the treatment, such as rollers.
4. The device includes a stand which is portable and self-contained, and includes a post made up of sections, the upper one being detachably mounted in the lower one, enabling treatment of the hair piece thereon when in mounted position, and further enabling removal of the upper section with a treated hair piece on it, for temporarily storing it, and placing an empty upper section again on the holder.

BRIEF DESCRIPTION OF THE INDIVIDUAL FIGURES OF THE DRAWINGS

FIG. 5 is a view of a clip, for holding the hair piece, the clip being mounted on the upper part of the device.

FIG. 6 is a side view, oriented according to FIG. 1, of the cross bar of the device with hair pieces mounted thereon.

FIG. 7 is a fragmentary view of a modified form of cross bar.

FIG. 8 is a fragmentary view of a modified form of the lower part of the device.

DETAILED DESCRIPTION OF THE DRAWINGS

Figure 4:
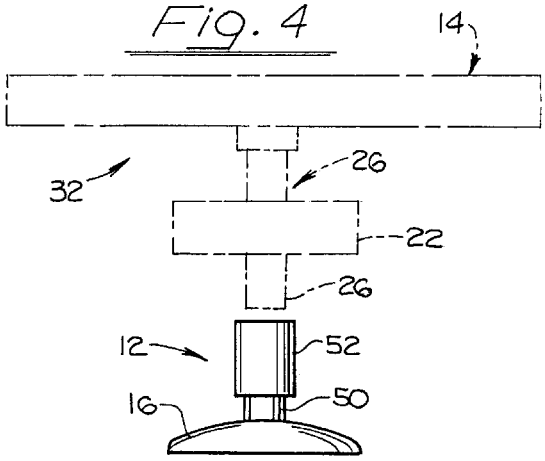
FIG. 4 is an auxiliary base for temporarily holding the upper part of the main device.

The device in its entirety is indicated at 10 and includes a main component or part 11 (FIG. 1) and an auxiliary stand 12 shown in full lines in FIG. 4. The main component includes a stand 13 and a cross bar 14 at the top of the stand.

The stand includes a base 16 of suitable character and construction, and a main post 18 mounted thereon and extending upwardly therefrom. Mounted on the post 18 is a basket 20 in a lowermost position, and above the basket is a cup 22, substantially smaller than the basket.

Figure 2:
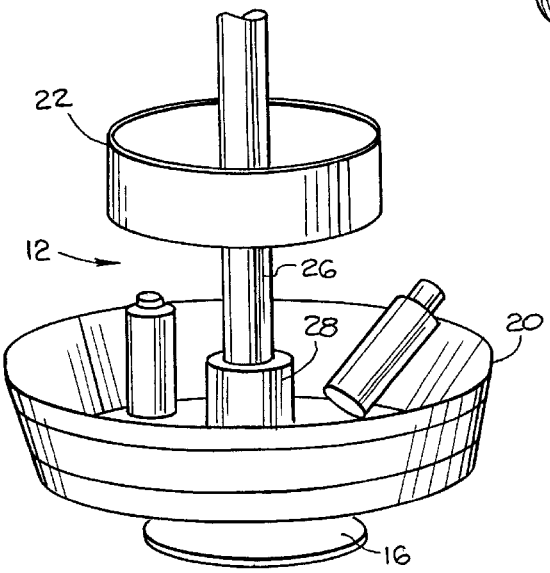
FIG. 2 is a perspective view of the lower part of the device, taken from above and at an angle.

The post 18 is made up of two sections, namely a lower section 24 which is mounted directly on the base, and an upper section 26 detachably mounted on the lower section. FIG. 2 shows the post 18 to good advantage, the lower section having a socket 28 on its upper end, in which the lower end of the upper section 26 is detachably fitted, the upper section, with the cross bar being thus releasably held in position. The basket 20, is of substantial size, or diameter, and is mounted on the lower section 24 in any suitable construction, and is used for containing or supporting various items 25 used in hair treatment, such as solutions, adhesives, etc.

Figure 3:
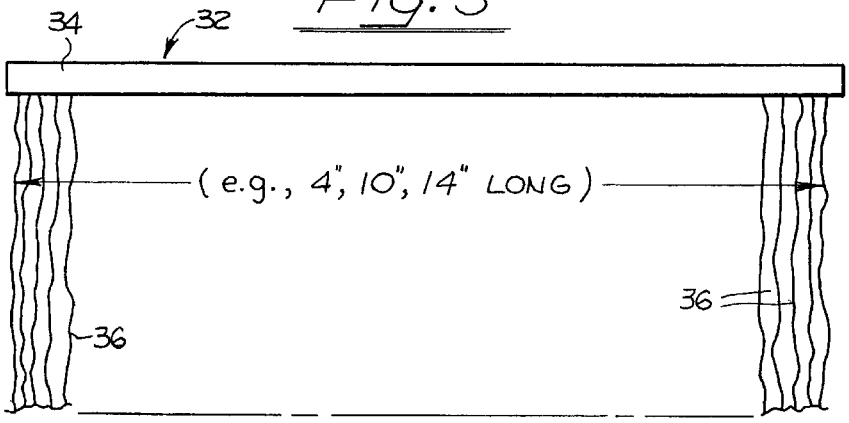
FIG. 3 is a face view of a hair piece, to be held by the device.

The device finds particular use in treating and handling hair pieces, indicated at 32 (FIG. 3), as well as in fitting them to the head. Such a hair piece is to be fitted to the head and secured in place as by adhesive. The hair piece itself is of known kind, and has a longitudinal band 34 and a plurality of filaments 36 representing or constituting hairs, secured at one end to the band and extending laterally therefrom. These hair pieces are of indeterminate length, and may be relatively short or long, as indicated in FIG. 3. The band 34 is fitted to the scalp and secured thereto, and the filaments, or hairs, 36 fall in place among the natural hairs and blend therewith to provide the appearance of a continuous mat of natural hair. The band 34 provides the strength and structure or "framework" of the hair piece, not only determining its length, but holding the filaments or hairs in proper position.

In handling the hair piece, in the treatment of the patrons hair, various solutions and adhesives are used, and in this step the hair pieces are mounted on the cross bar 14 (FIG. 6), and the articles 25 in the basket 20 are used, hence the relative large dimensions of the basket for holding the necessary articles.

The cup 22 is used in a different step in the treatment, from that of the basket 20, and is placed above the basket and is for holding other articles used in hair treatment, such as rollers, pins, etc. This cup is mounted on and carried by the upper post section 26.

In the treatment of the hair pieces, in utilizing the device of the invention, the pieces are mounted on the cross bar 14. The cross bar may be of suitable construction, such as tubular, of cylindrical shape (FIG. 5) and for mounting the hair piece thereon, clips 37 are utilized. These clips may be of standard construction, and they releasably hold the hair piece, by gripping the strip 34. The clips are mounted on the cross bar by ears 38 secured to the cross bar as by soldering, at 39, these ears having keyhole slots 40, the clips being provided with rivets 41 that detachably fit in the slots. Other means may be used instead, for mounting the clips 37, such as holes 45 (FIG. 6) in the cross bar for receiving the rivets 41 on the clips, or rivets on loose ears 38; or the cross bar may have a longitudinal slot 43 (FIG. 1) for receiving the rivets, enabling sliding of the clips along the cross bar.

The number of clips 37 utilized on the cross bar may be as desired, according to the length of the hair pieces to be treated, and the habits of the operator. The hair piece, as noted, may be of any of various lengths, and as shown at the left end of FIG. 6, a hair piece 32*a* is utilized, having a strip 34*a,* forming a short strip, i.e. short in the direction of the length of the strip. In this case it is held by only two clips 38.

At the right hand side of FIG. 6 a longer hair piece 32*b* is shown, having a backing strip 34*b* of corresponding length, this length being greater than that of the piece at the left hand side. In this case a greater number of clips 38 are used.

In FIG. 6 the hair pieces are of different lengths, and both shorter than a maximum that may be accommodated. A practical length of the cross bar 14 is 18", this being an example, and not as limiting.

The auxiliary stand 12 (FIG. 4), referred to, includes an auxiliary base 48 similar to the base 16, and an auxiliary post 50. The post 50 is relatively short and may be for example of the length of the lower section 24 of the post 18, and includes a socket 52 at the top, similar to the socket 28 (FIG. 2) of the main component.

As the hair treatment proceeds, and the hair pieces are in place on the cross bar after early stage in the treatment, in a later stage, the upper part of the stand, i.e. the upper section 26 of the post, is lifted out of the socket 28, the cross bar of course being carried with it, and such sub unit put in place in the auxiliary stand 12 (FIG. 4), i.e. the upper section 26 is fitted in the socket 52.

The cup 22 is carried with the upper section 26 in placing the latter on the auxiliary stand. In this situation, the operator, or an assistant, can give further treatment to the hair strips that are then carried on the auxiliary stand.

In both cases, the hair pieces are held entirely by the stand, leaving the operators hands free for complete treatment of the hair pieces. Heretofore it has been impossible or difficult to give efficient and effective treatment to the hair piece, because it was necessary to hold the hair piece by the hand, limiting the dexterity of the operator. In the present case the hair piece can be quickly put in place on the cross bar, the clips releasably holding it in place. The provision of the auxiliary stand 12, that is used with the same upper part of the main component, provides great flexibility and capability of the device in holding the hair pieces and enabling proper manipulation thereof.

Figure 1:
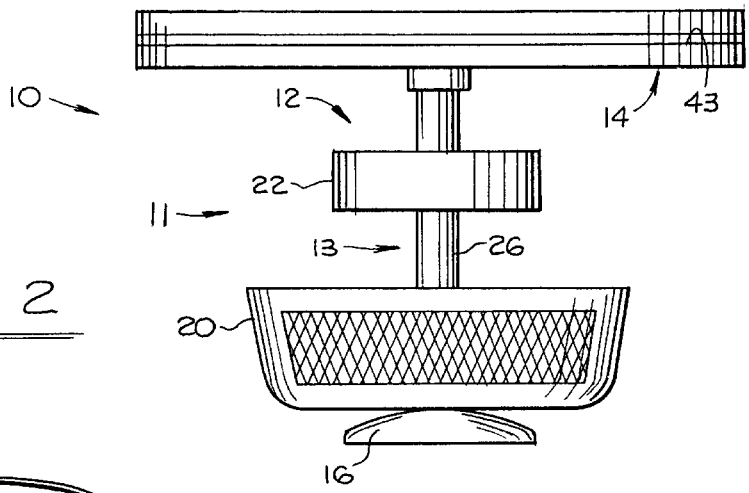
FIG. 1 is a side elevational view of the main part of the device of the invention.

While in the preferred construction, the cross bar 14 is a single piece, as in FIG. 1, a modified form may be used, as shown in FIG. 7. In the latter case, the cross bar 54 includes a main section 55 which is a single piece, and extensions 56 slidably fitted therein. They are slidable from inner positions shown at the left, to outer positions shown at the right, these extensions providing greater length or capacity. They are provided with holes 58 for receiving the rivets 40 in the clips 37, for detachably mounting the clips.

In the alternative construction of FIG. 8, the stand includes a base 58 having a tubular post 60. The upper part 61 includes a lower element 63 telescopically and slidingly fitted in the post 60 and is releasably held by a suitable means 64 for enabling vertical adjustment of the upper part, and thus of the stand. The element 63 has a cup 65 similar to the cup 28 in construction and function.

End of Descriptive Specification

I claim:

1. A beautician's portable helper comprising, a main base, a main post secured to and extending upwardly from the main base, a basket mounted on the main post in a lower position above the main base, a cup smaller than the basket mounted on the main post and positioned above the basket, an elongated cross bar mounted on the main post at the top of the latter, and means for releasably securing a hair piece on the cross bar in position extending along the cross bar, and at a plurality of points along the cross bar.

2. A beautician's helper according to claim 1, which constitutes a main stand, in combination with, an auxiliary stand including an auxiliary base and an auxiliary post section, both said stands being portable, the main post including a lower section and an upper section, said cup is mounted on the upper post section, and means detachably securing the main post sections together, the upper section with the cross bar thereon, and with the cup thereon being removable as a unit from the lower section and replaceable on the auxiliary post section.

3. A beautician's helper according to claim 1 wherein, the securing means includes a plurality of clips mounted on the cross bar in spaced relation therealong, the means for mounting the clips include a longitudinal slot in the cross bar, and the clips have rivets slidable in the slot.

4. A beautician's helper according to claim 2 wherein, the means securing the lower and upper sections together includes a socket on the lower post section and the upper post section is releasably fitted in the socket, and the auxiliary post includes a socket similar to that on the lower section of the main post, and both said sockets being capable of releasably receiving the upper section of the main post for holding it in upright position.

5. A beautician's helper according to claim 2 wherein, the lower section of the post is made up of telescoped sub-sections adjustable vertically relatively to each other to correspondingly adjust the vertical length of the stand.

6. A beautician's portable helper comprising, a main base, a main post secured to and extending upwardly from the main base, a basket mounted on the main post in a lower position above the main base, a cup smaller than the basket mounted on the main post and positioned above the basket, a cross bar mounted on the main post at the top of the latter, and means for releasably securing a hair piece on the cross bar in position extending along the cross bar, the securing means including a plurality of clips mounted on the cross bar in spaced relation therealong, the means for mounting the clips including ears secured to the cross bar, the ears having keyhole slots, and the clips having rivets releasably fitted in the slots.

7. A beautician's helper according to claim 6 wherein, the cross bar has a longitudinal slot, and the ears have rivets slidable in the slot.

8. A beautician's helper according to claim 6 wherein, the cross bar includes a central stationary main section, and end extensions mounted thereon and slidable between inner retracted positions and outer extended positions.

* * * * *